US007260867B2

(12) United States Patent
Overvaag

(10) Patent No.: US 7,260,867 B2
(45) Date of Patent: Aug. 28, 2007

(54) BAGLESS DUST BOX FOR VACUUM CLEANER

(75) Inventor: Chad D. Overvaag, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 608 days.

(21) Appl. No.: 10/683,187

(22) Filed: Oct. 10, 2003

(65) Prior Publication Data

US 2004/0074041 A1 Apr. 22, 2004

Related U.S. Application Data

(60) Provisional application No. 60/417,970, filed on Oct. 11, 2002.

(51) Int. Cl.
*A47L 9/16* (2006.01)

(52) U.S. Cl. ..... 15/347; 15/353; 55/337; 55/DIG. 3

(58) Field of Classification Search ..... 15/327.1, 15/327.2, 327.3, 327.4, 327.5, 327.6, 327.7, 15/347, 350–353; 55/337, 429, 459.1, DIG. 3
See application file for complete search history.

(56) References Cited

U.S. PATENT DOCUMENTS

| | | | | |
|---|---|---|---|---|
| 2,785,767 | A * | 3/1957 | Glidden | 55/315 |
| 5,287,591 | A * | 2/1994 | Rench et al. | 15/328 |
| 6,003,196 | A * | 12/1999 | Wright et al. | 15/353 |
| 6,026,540 | A | 2/2000 | Wright et al. | |
| 6,070,291 | A | 6/2000 | Bair et al. | |
| 6,146,434 | A | 11/2000 | Scalfani et al. | |
| 6,260,234 | B1 | 7/2001 | Wright et al. | |
| 6,341,404 | B1 | 1/2002 | Salo et al. | |
| 6,353,963 | B1 | 3/2002 | Bair et al. | |
| 6,401,295 | B2 | 6/2002 | Bair et al. | |
| 6,428,589 | B1 | 8/2002 | Bair et al. | |
| 6,436,160 | B1 | 8/2002 | Stephens et al. | |
| 6,463,622 | B2 | 10/2002 | Wright et al. | |
| 6,558,453 | B2 * | 5/2003 | Sepke et al. | 95/268 |
| 6,591,446 | B2 | 7/2003 | Bair et al. | |
| 6,829,804 | B2 | 12/2004 | Sepke | |
| 2002/0029436 | A1 | 3/2002 | Hawkins et al. | |
| 2002/0095741 | A1 * | 7/2002 | Inoue et al. | 15/350 |
| 2003/0084536 | A1 * | 5/2003 | Yung | 15/351 |
| 2004/0010885 | A1 | 1/2004 | Hitzelberger et al. | |
| 2004/0034962 | A1 * | 2/2004 | Thur et al. | 15/353 |
| 2004/0074041 | A1 | 4/2004 | Overvaag | |
| 2004/0154126 | A1 * | 8/2004 | Hansen et al. | 15/353 |

FOREIGN PATENT DOCUMENTS

| | | |
|---|---|---|
| JP | 56-136642 | 10/1981 |
| JP | 56-136650 | 10/1981 |
| JP | 11-290724 | * 10/1999 |

* cited by examiner

*Primary Examiner*—Terrence R. Till
(74) *Attorney, Agent, or Firm*—King & Schickli, PLLC

(57) ABSTRACT

A vacuum cleaner is provided including a housing, a nozzle inlet, a suction generator carried on the housing and a dust box carried on the housing. Additionally, a partition is provided dividing the dust box into a coarse particle dirt collecting chamber and a fine particle filtering chamber. Further, a filter assembly including a support frame and a filter element is provided. The support frame holds the filter element in the filtering chamber.

27 Claims, 3 Drawing Sheets

BAGLESS DUST BOX FOR VACUUM CLEANER

This application claims the benefit of U.S. Provisional Patent Application Ser. No. 60/417,970 filed Oct. 11, 2002.

TECHNICAL FIELD

The present invention relates generally to the floor care equipment field and, more particularly, to a dirt collection assembly for an upright or canister vacuum cleaner.

BACKGROUND OF THE INVENTION

Bagless vacuum cleaner technology has long been known in the art. Japanese Patent Applications 56-136642 and 56-136650 both published in 1981 disclose an upright vacuum cleaner with a dust collection chamber that removably connects to an opening of the main unit to facilitate user convenience during the emptying of the cleaner. A removable filter fills an opening at the bottom of the dust chamber and serves to separate dust from air drawn through the vacuum cleaner by the fan and motor assembly.

The present invention relates to an improved dirt collection assembly for an upright or canister vacuum cleaner.

SUMMARY OF THE INVENTION

In accordance with the purposes of the present invention as described herein, an improved vacuum cleaner is provided. That vacuum cleaner comprises a housing, a nozzle inlet, a suction generator carried on the housing and a dust box. Additionally, the vacuum cleaner includes a partition dividing the dust box into a coarse particle dirt collecting chamber and a fine particle filtering chamber. A filter assembly including a support frame and a filter element are also provided. The support frame holds the filter element in the filtering chamber.

More specifically describing the invention, the dust box includes an air inlet and the partition includes an opening providing fluid communication between the dirt collecting chamber and the filtering chamber. That opening may be covered by a screen, grating or the like and provides a coarse filtering function. The support frame includes an air outlet. The dirt box includes a top wall, a sidewall and a bottom wall. In one embodiment the top wall may be formed by a removable lid that is connected to the sidewall.

In accordance with another aspect of the present invention, the dirt collecting chamber may be cylindrical in shape. Similarly, the partition and the filtering chamber may both be cylindrical in shape and both concentrically received within the dust box. The air inlet may be provided in the sidewall and substantially tangentially directed with respect to the dirt collecting chamber. This induces a vortex airflow in the dirt collecting chamber thereby providing cyclonic action for more efficient cleaning of coarse dirt and debris from the airstream. The volume of the dirt collecting chamber may be between 1.5 and 20 times greater than the volume of the filtering chamber. The filtering element may also be cylindrical in shape. Further, the filtering element may include a pleated filter media of a type well known in the art to be useful in vacuum cleaners.

The support frame includes a filter support and a first mounting element. The bottom wall of the dust box includes a second mounting element. The first and second mounting elements mate to secure the filter support to the dust box and, consequently, the filter element in the filtering chamber.

In accordance with yet another aspect of the present invention, a dirt collection assembly as described above is provided in the absence of the remaining structure of a vacuum cleaner.

In the following description there is shown and described a preferred embodiment of the invention simply by way of illustration of one of the modes best suited to carry out the invention. As it will be realized, the invention is capable of other different embodiments and its several details are capable of modification in various obvious aspects all without departing from the invention. Accordingly, the drawings and descriptions will be regarded as illustrative in nature and not as restrictive.

BRIEF DESCRIPTION OF THE DRAWING FIGURES

The accompanying drawing incorporated in and forming a part of this specification, illustrates several aspects of the present invention, and together with the description serves to explain certain principles of the invention. In the drawing.

Reference will now be made in detail to the present preferred embodiment of the invention, an example of which is illustrated in the accompanying drawing.

DETAILED DESCRIPTION OF THE INVENTION

Figure 1:
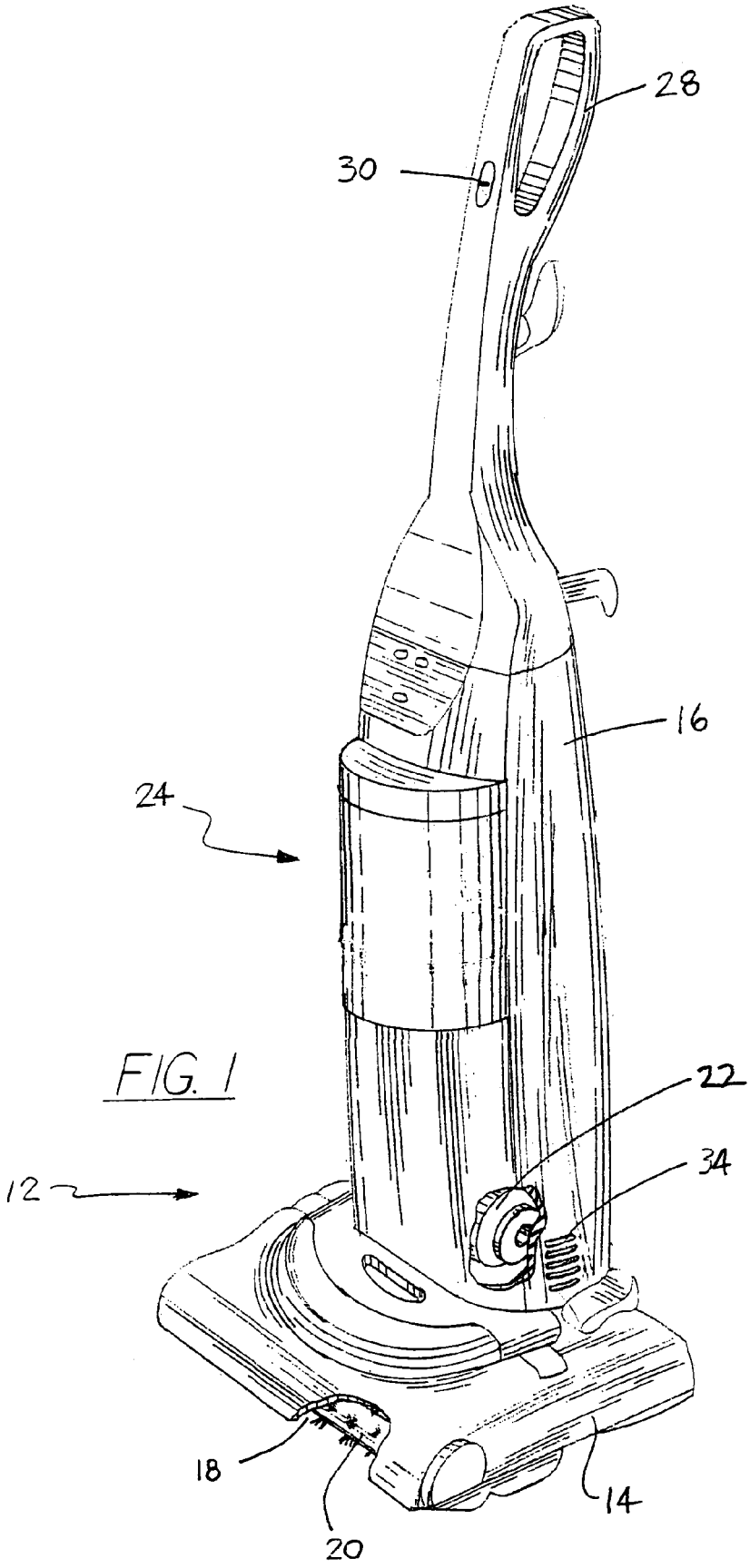
FIG. 1 is a perspective view of one possible embodiment of the vacuum cleaner of the present invention.

Reference is now made to FIG. 1 illustrating one possible embodiment of the vacuum cleaner 10 of the present invention. The illustrated embodiment is an upright vacuum cleaner 10. It should be appreciated, however, that the present invention also includes and this patent covers canister and hand-held, bagless vacuum cleaners.

The vacuum cleaner 10 includes a housing, generally designated by reference numeral 12, including a nozzle section 14 and a canister section 16. As is known in the art, the canister section 16 is pivotally connected to the nozzle section 14 to aid the operator in manipulating the vacuum cleaner to and fro across the floor. Wheels (not shown) carried on the housing 12 allow the vacuum cleaner 10 to be moved smoothly across the floor.

As illustrated, the nozzle section 14 is equipped with a nozzle inlet 18. In the illustrated embodiment, the nozzle inlet 18 also includes a rotary agitator 20. The canister section 16 houses a suction generator 22 (i.e. a fan and motor assembly), a dust box 24 and a filter compartment 26. The canister section 16 also includes a control handle 28 and an actuator switch 30 for turning the vacuum cleaner 10 on and off and thereby driving the rotary agitator 20 and the suction generator 22.

During the cleaning operation the rotary agitator 20 brushes and beats dirt and debris from the nap of an underlying carpet being cleaned. That dirt and debris is then drawn by the suction generator 22 through the nozzle inlet 18 into the dust box 24 where the majority of the dirt and debris and, more particularly, the relatively coarse dirt and debris is collected. Next, the relatively clean air is drawn through the filter compartment 26 where a filter element 32 cleans the air of substantially any remaining fine particles that are able to pass through the dust box 24. The airstream is then directed over the motor of the suction generator 22 to provide cooling before being routed through a final filter, to remove any carbon particles stripped from the suction fan and motor by the airstream before exhausting the airstream through an exhaust port 34 into the environment.

Figure 2:
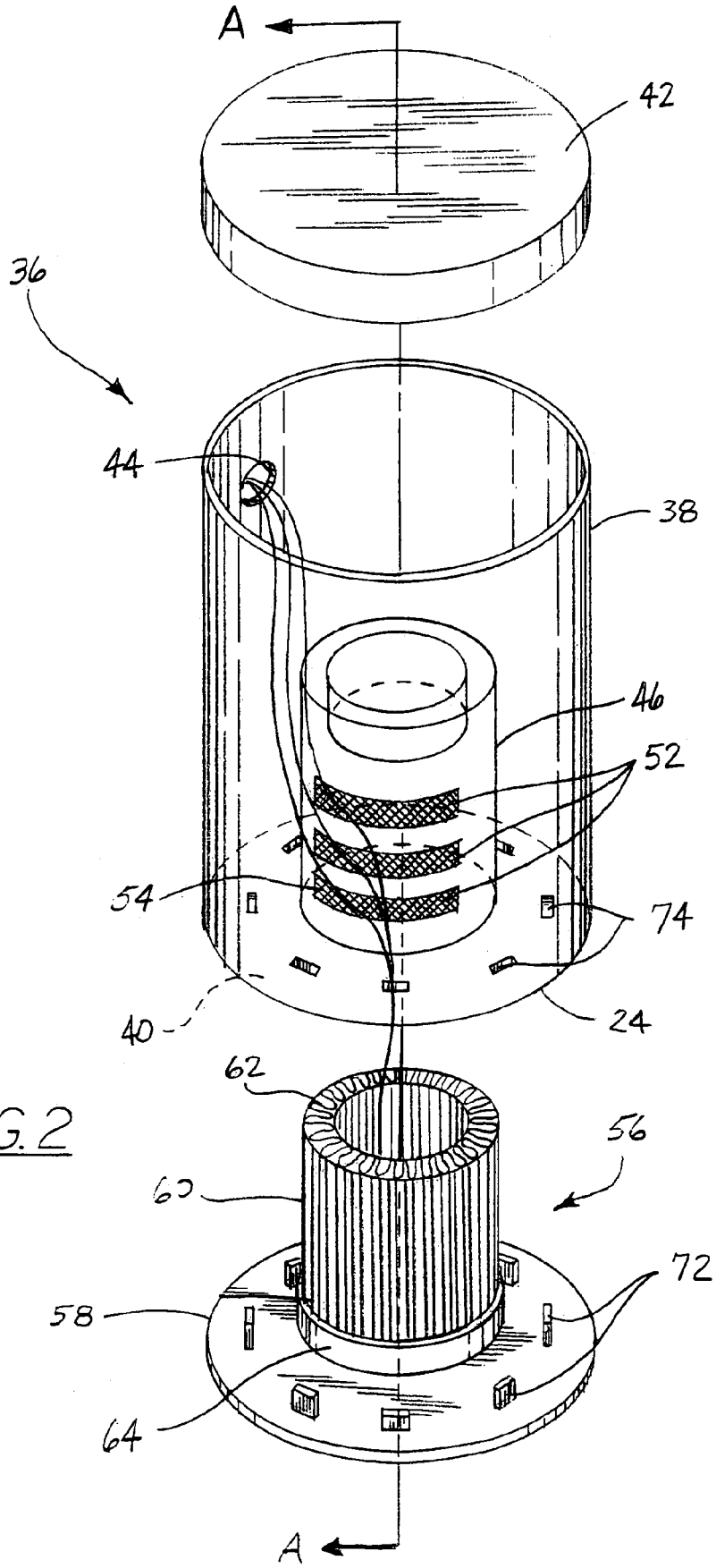
FIG. 2 is a detailed, exploded perspective view illustrating the dirt collection assembly of the present invention.
Figure 3:
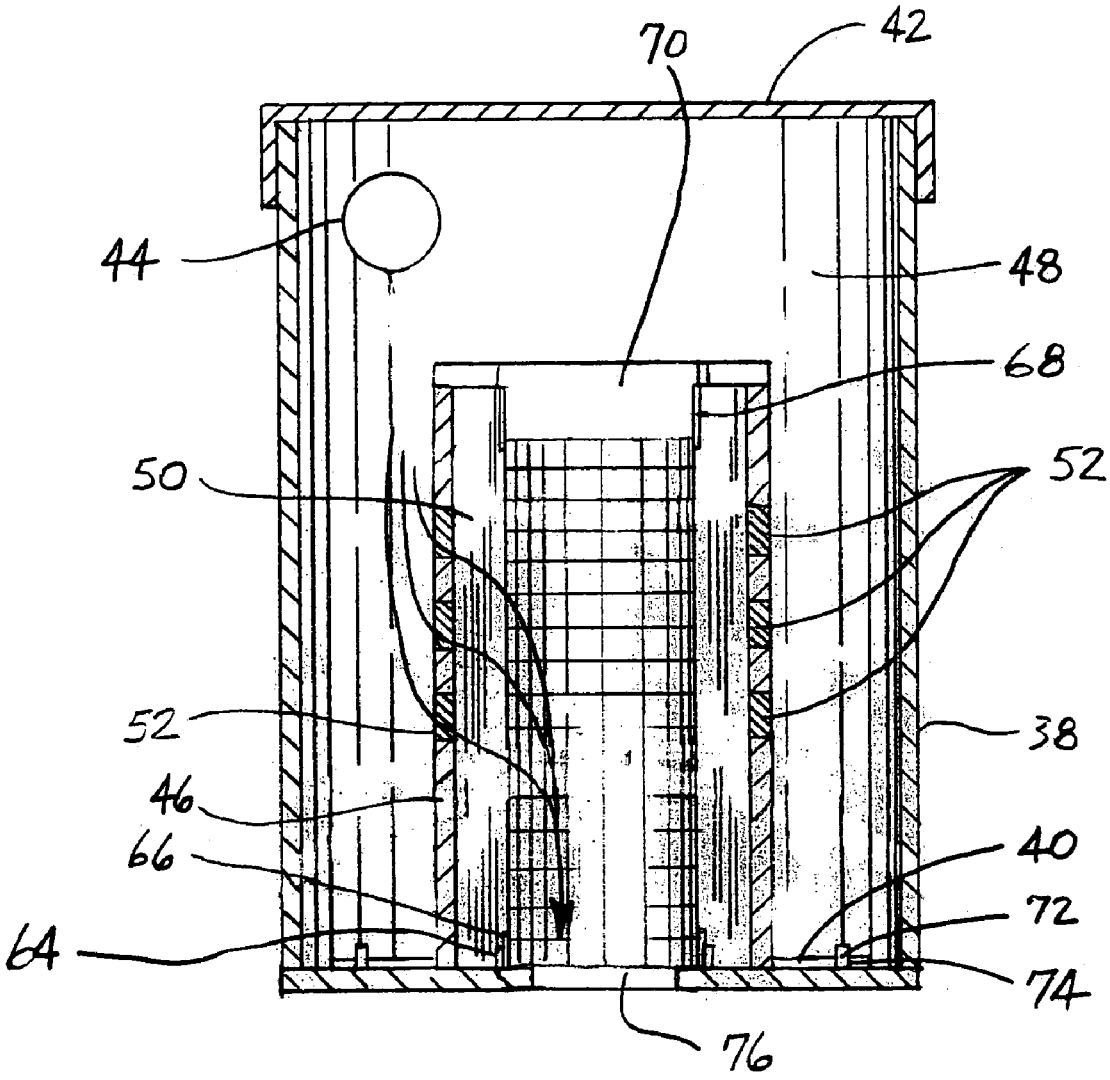
FIG. 3 is a partially schematical and cross sectional view of the dirt collection assembly taken along line AA of FIG. 2.

The dirt collection assembly 36 of the present invention is best illustrated in FIGS. 2 and 3. The dirt collection assembly 36 includes the dust box 24 having a sidewall 38, an annular bottom wall 40 and an upper wall 42 formed by a removable lid that may be releasably connected to the sidewall.

A dirty air inlet 44 is provided in the sidewall 38. A partition 46 divides the dust box 24 into a coarse particle dirt collecting chamber 48 and a filtering chamber 50. In the illustrated embodiment the dirt collecting chamber 48 and the filtering chamber 50 are both cylindrical in shape. Additionally, the air inlet is tangentially directed with respect to the dirt collecting chamber 48 so as to define a vortex airstream in the dirt collecting chamber 48. The resulting cyclonic cleaning action provides enhanced cleaning efficiency for many applications under various operating conditions.

At least one opening 52 is provided in the partition. The opening 52 provides fluid communication between the dirt collecting chamber 48 and the filtering chamber 50. In the illustrated embodiment the opening 52 comprises a series of arcuate slots covered by a screen, grating or the like 54 that filters relatively coarse dirt and debris from the airstream.

A filter assembly 56 is mounted in the filtering chamber defined by the partition 46. The filter assembly 56 includes a support frame 58 and an upstanding filter element 60. In the illustrated embodiment the filter element 60 is substantially cylindrical in shape. It also comprises a pleated filter material 62 known in the art to be useful for cleaning airstreams traveling through a vacuum cleaner.

The support frame 58 includes a filter support 64 for holding a base 66 of the filter element 60. When properly inserted and seated in the filtering chamber 50, the top 68 of the filter element is closed, seated on and supported by a second filter support 70 formed or carried by the partition 46.

The support frame 58 includes a first mounting element 72. The bottom wall 40 of the dust box 24 includes a second mounting element 74. The first and second mounting elements 72, 74 mate together and thereby function to secure the support frame 58 to the bottom wall 40 of the dust box 24 and, consequently, the filter element 60 in the filtering chamber 50. In the illustrated embodiment, the first and second mounting elements 72, 74 comprise cooperating tabs and slots which may be provided on the support frame 58 and bottom wall 40 in any reciprocal combination.

During operation of the vacuum cleaner 10, the rotary agitator 20 brushes and beats dirt and debris from the nap of an underlying carpet being cleaned. That dirt and debris is then drawn by the suction generator 22 through the nozzle inlet 18 and then through the air inlet 44 into the dirt collecting chamber 48. The cyclonic movement of the airstream in the dirt collecting chamber 48 causes dirt and debris to be forced against the sidewall 38 and then collected under the force of gravity along the annular bottom wall 40. Next the airstream is drawn through the openings 52. The screens 54 across the openings 52 prevent the passage of any coarse dirt and debris. After entering the filtering chamber 50, the airstream is drawn through the pleated filter material 62 of the filter element 60. The filter element 60 removes substantially any remaining fine particles of dirt and debris from the airstream. The now clean airstream is then drawn through the air outlet 76 in the support frame 58. The airstream then flows over the motor of the suction generator 22 so as to provide cooling. The airstream is then exhausted through an exhaust port 34 into the environment.

At various times during the cleaning operation the dirt collecting chamber 48 will fill with dirt and debris. This dirt and debris may be emptied by removing the dirt collection assembly 36 from the vacuum cleaner housing 12, opening the top wall or lid 42 and inverting the dust box 24 so that gravity pulls the contents into an underlying garbage can, sack or bag.

It should be appreciated that the filter assembly 56 is held in a separate cavity or filtering chamber 50 outside the dust collecting chamber 48. Thus, the filter assembly 56 in no way interferes with the emptying of the dirt collecting chamber 48.

The filter assembly 56 is also easy to clean. Specifically, the support frame 58 may be pulled/twisted in order to disconnect the first and second mounting elements 72, 74 and free the support frame 58 from the bottom wall 40 of the dust box 24. The filter element 60 is then removed from the filtering chamber 50. The filter element 60 may then be cleaned in a number of possible ways. It could be removed from the filter support 64 and washed. Alternatively, the support frame 58 could be provided with a control handle (not shown) that is turned in order to rotate a resilient clicker against the inside wall of the filter element 60. This beating/vibrating action frees fine particles from the filter material 62 so that those particles drop into the underlying garbage can. Finally, the filter element 60 could simply be discarded and replaced with a new filter element.

The foregoing description of the preferred embodiment of the invention has been presented for purposes of illustration and description. It is not intended to be exhaustive or to limit the invention to the precise form disclosed. Obvious modifications or variations are possible in light the above teachings.

For example, while the dirt collecting chamber 48, filtering chamber 50 and filter assembly 56 in the illustrated embodiment are all cylindrical in shape, any one or all of these structures may assume substantially any other shape. Accordingly, it should be appreciated that while the illustrated embodiment takes advantage of the added cleaning efficiency provided by cyclonic airflow, the present invention is not limited to cyclonic airflow embodiments. Further, while the suction generator 22 in the illustrated embodiment is located downstream from the dust box 24 it could also be located upstream therefrom. Thus, it should be appreciated that the present invention may be utilized on "dirty air" vacuum cleaner systems.

The embodiment was chosen and described to provide the best illustration of the principles of the invention and its practical application to thereby enable one of ordinary skill in the art to utilize the invention in various embodiments and with various modifications as are suited the particular use contemplated. All such modifications and variations are within the scope of the invention as determined by the appended claims when interpreted in accordance with the breadth, to which they are fairly, legally and equitably entitled. The drawings and preferred embodiment do not and are not intended to limit the ordinary meaning of the claims and their fair and broad interpretation in any way.

What is claimed is:

1. A dirt collection assembly, comprising:

a dust box including an air inlet, a bottom wall and an air outlet extending through said bottom wall;

a partition dividing said dust box into a coarse particle dirt collecting chamber and a fine particle filtering chamber wherein said filtering chamber is concentrically received within said dirt collecting chamber; and a filter assembly including a support frame and a filter element, said support frame holding said filter element in said filtering chamber.

2. The dirt collection assembly of claim 1, wherein said partition includes an opening providing fluid communication between said dirt collecting chamber and said filtering chamber and said air outlet extends through said support frame.

3. The dirt collection assembly of claim 2, wherein said opening is covered by a screen.

4. The dirt collection assembly of claim 1, wherein said dust box includes a sidewall, said air inlet being provided in said sidewall.

5. The dirt collection assembly of claim 4, wherein said sidewall is cylindrical and said air inlet is substantially tangentially directed with respect to said dirt collecting chamber.

6. The dirt collection assembly of claim 5, wherein said dirt collecting chamber has a volume between 1.5 and 20 times said filtering chamber.

7. The dirt collection assembly of claim 6, wherein said filter element includes a pleated filter media.

8. The dirt collection assembly of claim 7, wherein said filter element is cylindrical in shape.

9. The dirt collection assembly of claim 8, wherein said partition is concentrically received in said dust box so that at least a portion of said dirt collecting chamber is annular in shape.

10. The dirt collection assembly of claim 9, wherein said opening is at least one arcuate shaped slot.

11. The dirt collection assembly of claim 10, wherein said support frame includes a filter support and a first mounting element.

12. The dirt collection assembly of claim 11, wherein said bottom wall includes a second mounting element for mating with said first mounting element and securing said filter support to said dust box.

13. A vacuum cleaner, comprising:

a housing;

a nozzle inlet;

a suction generator carried on said housing;

a dust box carried on said housing, said dust box including an air inlet, a bottom wall and an air outlet extending through said bottom wall;

a partition dividing said dust box into a coarse particle dirt collecting chamber and a fine particle filtering chamber wherein said filtering chamber is concentrically received within said dirt collecting chamber; and a filter assembly including a support frame and a filter element, said support frame holding said filter element in said filtering chamber.

14. The vacuum cleaner of claim 13, wherein said partition includes an opening providing fluid communication between said dirt collecting chamber and said filtering chamber and said air outlet extends through said support frame.

15. The vacuum cleaner of claim 14, wherein said opening is covered by a screen.

16. The vacuum cleaner of claim 13, wherein said dust box includes a sidewall, said air inlet being provided in said sidewall.

17. The vacuum cleaner of claim 16, wherein said sidewall is cylindrical and said air inlet is substantially tangentially directed with respect to said dirt collecting chamber.

18. The vacuum cleaner of claim 17, wherein said dirt collecting chamber has a volume between 1.5 and 20 times said filtering chamber.

19. The vacuum cleaner of claim 18, wherein said filter element includes a pleated filter media.

20. The vacuum cleaner of claim 19, wherein said filter element is cylindrical in shape.

21. The vacuum cleaner of claim 20, wherein said partition is concentrically received in said dust box so that at least a portion of said dirt collecting chamber is annular in shape.

22. The vacuum cleaner of claim 21, wherein said opening is at least one arcuate shaped slot.

23. The vacuum cleaner of claim 22, wherein said support frame includes a filter support and a first mounting element.

24. The vacuum cleaner of claim 23, wherein said bottom wall includes a second mounting element for mating with said first mounting element and securing said filter support to said dust box.

25. The vacuum cleaner of claim 13 wherein said housing includes a nozzle section including said nozzle inlet and a canister section.

26. The vacuum cleaner of claim 25, wherein said nozzle section and said canister section are pivotally connected together.

27. The vacuum cleaner of claim 26, wherein said dust box includes a top wall formed by a removable lid connected to said sidewall.

* * * * *